US007798918B2

(12) United States Patent
Ban et al.

(10) Patent No.: US 7,798,918 B2
(45) Date of Patent: Sep. 21, 2010

(54) METHOD OF MANUFACTURING GOLF CLUB HEAD AND GOLF CLUB HEAD

(75) Inventors: Wataru Ban, Chichibu (JP); Fumiaki Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 90 days.

(21) Appl. No.: 11/856,936

(22) Filed: Sep. 18, 2007

(65) Prior Publication Data

US 2009/0029797 A1 Jan. 29, 2009

(30) Foreign Application Priority Data

Jul. 24, 2007 (JP) ..... 2007-192623

(51) Int. Cl.
*A63B 53/04* (2006.01)

(52) U.S. Cl. ..... 473/330

(58) Field of Classification Search ..... 473/324–350
See application file for complete search history.

(56) References Cited

U.S. PATENT DOCUMENTS

| | | | | |
|---|---|---|---|---|
| 1,289,553 | A | 12/1918 | Sanders | |
| 1,337,958 | A | 4/1920 | Reach | |
| 2,005,401 | A | 4/1933 | Storz | |
| 1,965,954 | A | 7/1934 | Davis | |
| D190,035 | S | 4/1961 | Hansen, Jr. | |
| 3,693,978 | A | 9/1972 | East | |
| 4,067,572 | A | 1/1978 | Coleman | |
| 4,413,825 | A | 11/1983 | Sasse | |
| 4,753,440 | A | 6/1988 | Chorne | |
| 4,858,929 | A | 8/1989 | Long | |
| 4,957,294 | A | 9/1990 | Long | |
| 5,029,864 | A | 7/1991 | Keener | |
| 5,100,144 | A | 3/1992 | Okumoto et al. | |
| 5,437,088 | A * | 8/1995 | Igarashi | 29/527.6 |
| 5,591,092 | A * | 1/1997 | Gilbert | 473/330 |
| 5,637,044 | A | 6/1997 | Swash | |
| 5,688,186 | A | 11/1997 | Michaels et al. | |
| 5,709,616 | A | 1/1998 | Rife | |
| 5,744,780 | A | 4/1998 | Chang et al. | |
| 5,766,087 | A * | 6/1998 | Kawamatsu | 473/290 |
| 5,766,097 | A | 6/1998 | Horiuchi et al. | |
| 5,785,610 | A * | 7/1998 | Birmingham | 473/331 |
| 5,788,584 | A | 8/1998 | Parente et al. | |
| 6,733,400 | B2 | 5/2004 | Sherwood | |
| 6,814,673 | B2 * | 11/2004 | Wahl et al. | 473/331 |
| 6,849,004 | B2 | 2/2005 | Lindsay | |

(Continued)

FOREIGN PATENT DOCUMENTS

JP 02-026574 A 1/1990

(Continued)

*Primary Examiner*—Alvin A Hunter
(74) *Attorney, Agent, or Firm*—Paul, Hastings, Janofsky & Walker LLP

(57) ABSTRACT

According to this invention, there is provided a method of manufacturing a golf cub head having a plurality of score lines on the face. The method of this invention includes the first forming step of forming grooves for the score lines on the face, and the second forming step of forming flat surfaces inclined with respect to the face by cutting into the edges of the grooves formed in the first forming step.

8 Claims, 7 Drawing Sheets

U.S. PATENT DOCUMENTS

| | | | | |
|---|---|---|---|---|
| 6,981,923 | B2 * | 1/2006 | Chappell | 473/330 |
| 7,014,568 | B2 * | 3/2006 | Pelz | 473/287 |
| 7,056,226 | B2 * | 6/2006 | Kennedy | 473/330 |
| 7,066,833 | B2 | 6/2006 | Yamamoto | |
| 7,156,751 | B2 | 1/2007 | Wahl et al. | |
| 7,159,292 | B2 | 1/2007 | Suzuki et al. | |
| 7,166,039 | B2 | 1/2007 | Hettinger et al. | |
| 7,179,175 | B2 * | 2/2007 | Kennedy, III | 473/330 |
| 7,192,361 | B2 | 3/2007 | Gilbert et al. | |
| 7,258,627 | B2 | 8/2007 | Chappell | |
| 7,275,999 | B2 | 10/2007 | Sherwood | |
| 7,285,057 | B2 * | 10/2007 | Mann et al. | 473/331 |
| 7,327,017 | B2 | 2/2008 | Sirinorakul et al. | |
| 2002/0016218 | A1 | 2/2002 | Takeda | |
| 2002/0042306 | A1 * | 4/2002 | Chappell | 473/331 |
| 2002/0132683 | A1 | 9/2002 | Buchanan | |
| 2003/0008724 | A1 | 1/2003 | Griffin | |
| 2004/0087387 | A1 * | 5/2004 | Wahl et al. | 473/330 |
| 2004/0214654 | A1 | 10/2004 | Pelz | |
| 2005/0037859 | A1 | 2/2005 | Gilbert et al. | |
| 2005/0075191 | A1 | 4/2005 | Bennett | |
| 2005/0085312 | A1 | 4/2005 | Nagai et al. | |
| 2005/0130761 | A1 | 6/2005 | Vokey et al. | |
| 2005/0143187 | A1 * | 6/2005 | Kennedy | 473/330 |
| 2006/0003851 | A1 * | 1/2006 | Chappell | 473/330 |
| 2006/0154739 | A1 | 7/2006 | Mann, Jr. et al. | |
| 2006/0223648 | A1 * | 10/2006 | Kennedy | 473/330 |
| 2007/0010346 | A1 | 1/2007 | Gilbert et al. | |
| 2007/0149312 | A1 * | 6/2007 | Gilbert | 473/330 |
| 2008/0020859 | A1 | 1/2008 | Yamagishi et al. | |
| 2008/0032814 | A1 * | 2/2008 | Ban | 473/330 |
| 2008/0051212 | A1 | 2/2008 | Voges | |
| 2008/0102981 | A1 * | 5/2008 | Nguyen et al. | 473/331 |
| 2008/0108453 | A1 | 5/2008 | Park et al. | |
| 2008/0125242 | A1 | 5/2008 | Ban | |
| 2008/0125243 | A1 | 5/2008 | Ban | |
| 2008/0132351 | A1 * | 6/2008 | Ban et al. | 473/331 |
| 2008/0132352 | A1 | 6/2008 | Ban | |
| 2008/0167138 | A1 | 7/2008 | Ban et al. | |
| 2008/0242442 | A1 * | 10/2008 | Gilbert et al. | 473/331 |
| 2009/0011852 | A1 * | 1/2009 | Solheim et al. | 473/331 |
| 2009/0029797 | A1 * | 1/2009 | Ban et al. | 473/331 |
| 2009/0036228 | A1 * | 2/2009 | Ban et al. | 473/331 |
| 2009/0082129 | A1 | 3/2009 | Ban et al. | |

FOREIGN PATENT DOCUMENTS

| | | | | |
|---|---|---|---|---|
| JP | 08-000777 | A | | 1/1996 |
| JP | 08-229169 | A | | 9/1996 |
| JP | 9-70457 | A | | 3/1997 |
| JP | 9-192274 | A | | 7/1997 |
| JP | 09253250 | A | | 9/1997 |
| JP | 09-308714 | A | | 12/1997 |
| JP | 09-308715 | A1 | | 12/1997 |
| JP | 10-015116 | A | | 1/1998 |
| JP | 10-179824 | A | | 7/1998 |
| JP | 10-248974 | A | | 9/1998 |
| JP | 2001178856 | A | * | 7/2001 |
| JP | 2002126135 | A | * | 5/2002 |
| JP | 2002-224250 | A1 | | 8/2002 |
| JP | 2002224250 | A | * | 8/2002 |
| JP | 2002-291949 | A | | 10/2002 |
| JP | 2003-093560 | A | | 4/2003 |
| JP | 2005-169129 | A | | 6/2005 |
| JP | 2005-287534 | A | | 10/2005 |
| JP | 2007-202633 | A | | 8/2007 |
| JP | 2008005994 | A | * | 1/2008 |
| JP | 2008-79969 | A | | 4/2008 |
| JP | 2001-170227 | A | | 8/2009 |
| WO | 00/02627 | A1 | | 1/2000 |
| WO | 00/74799 | A1 | | 12/2000 |
| WO | 01/97924 | A1 | | 12/2001 |
| WO | 03/045507 | A1 | | 6/2003 |

* cited by examiner

FIG. 5A

| | GROOVE WIDTH AND MEASUREMENT POSITION (mm) | | | | | | | | | STANDARD DEVIATION (SAME GROOVE) | ERROR RANGE (SAME GROOVE) |
|---|---|---|---|---|---|---|---|---|---|---|---|
| | -4.0 | -3.0 | -2.0 | -1.0 | 0 | +1.0 | +2.0 | +3.0 | +4.0 | | |
| #1 | 0.865 | 0.866 | 0.862 | 0.862 | 0.864 | 0.865 | 0.865 | 0.864 | 0.859 | 0.002 | 0.007 |
| #2 | 0.860 | 0.865 | 0.865 | 0.861 | 0.862 | 0.858 | 0.860 | 0.864 | 0.860 | 0.002 | 0.007 |
| #3 | 0.855 | 0.863 | 0.863 | 0.865 | 0.862 | 0.863 | 0.863 | 0.864 | 0.863 | 0.003 | 0.010 |
| #4 | 0.864 | 0.866 | 0.864 | 0.862 | 0.866 | 0.865 | 0.865 | 0.866 | 0.868 | 0.002 | 0.006 |
| STANDARD DEVIATION (BETWEEN GROOVES) | 0.004 | 0.002 | 0.001 | 0.002 | 0.002 | 0.003 | 0.002 | 0.001 | 0.004 | | |
| ERROR RANGE (BETWEEN GROOVES) | 0.010 | 0.004 | 0.002 | 0.004 | 0.005 | 0.007 | 0.005 | 0.002 | 0.009 | | |

| | |
|---|---|
| STANDARD DEVIATION AVERAGE (SAME GROOVE) | 0.002 |
| ERROR RANGE AVERAGE (SAME GROOVE) | 0.008 |
| STANDARD DEVIATION AVERAGE (BETWEEN GROOVES) | 0.002 |
| ERROR RANGE AVERAGE (BETWEEN GROOVES) | 0.005 |

FIG. 5B

| | GROOVE WIDTH AND MEASUREMENT POSITION (mm) | | | | | | | | | STANDARD DEVIATION (SAME GROOVE) | ERROR RANGE (SAME GROOVE) |
|---|---|---|---|---|---|---|---|---|---|---|---|
| | -4.0 | -3.0 | -2.0 | -1.0 | 0 | +1.0 | +2.0 | +3.0 | +4.0 | | |
| #1 | 0.741 | 0.732 | 0.738 | 0.754 | 0.725 | 0.750 | 0.749 | 0.742 | 0.732 | 0.010 | 0.029 |
| #2 | 0.695 | 0.706 | 0.697 | 0.695 | 0.694 | 0.694 | 0.703 | 0.704 | 0.701 | 0.005 | 0.012 |
| #3 | 0.691 | 0.694 | 0.673 | 0.684 | 0.672 | 0.653 | 0.657 | 0.672 | 0.673 | 0.014 | 0.041 |
| #4 | 0.730 | 0.737 | 0.735 | 0.718 | 0.729 | 0.719 | 0.725 | 0.712 | 0.741 | 0.010 | 0.030 |
| STANDARD DEVIATION (BETWEEN GROOVES) | 0.025 | 0.021 | 0.031 | 0.031 | 0.027 | 0.041 | 0.039 | 0.029 | 0.031 | | |
| ERROR RANGE (BETWEEN GROOVES) | 0.050 | 0.043 | 0.065 | 0.071 | 0.057 | 0.097 | 0.093 | 0.070 | 0.068 | | |

| | |
|---|---|
| STANDARD DEVIATION AVERAGE (SAME GROOVE) | 0.009 |
| ERROR RANGE AVERAGE (SAME GROOVE) | 0.028 |
| STANDARD DEVIATION AVERAGE (BETWEEN GROOVES) | 0.031 |
| ERROR RANGE AVERAGE (BETWEEN GROOVES) | 0.068 |

FIG. 6

| No. | IN FIRST FORMATION | | | | AFTER FLAT SURFACE FORMATION | | | TEST SHOT RESULT |
|---|---|---|---|---|---|---|---|---|
| | GROOVE WIDTH W2 (mm) | GROOVE DEPTH (mm) | ANGLE θ2 (°) | MACHIN-ABILITY | GROOVE WIDTH W1 (mm) | ANGLE θ1 (°) | MACHIN-ABILITY | |
| 1 | 0.8 | 0.48 | 90 | × | NOT MACHINED | | | BALL WAS EASILY DAMAGED |
| 2 | | | 85 | | | | | |
| 3 | 0.7 | | 80 | ○ | 0.90 | 50 | ○ | |
| 4 | 0.8 | | 75 | | 1.07 | 20 | | |
| 5 | | | 70 | | 0.90 | 15 | × | |
| 6 | | | | | | 25 | ○ | |
| 7 | | | | | | 35 | | |
| 8 | | | | | | 45 | | |
| 9 | | | | | | 55 | | BALL WAS EASILY DAMAGED |
| 10 | | | 65 | | 0.89 | 50 | | |
| 11 | | | 60 | | 0.86 | | | |
| 12 | | | 55 | | NOT MACHINED | | | LOW SPIN TENDENCY IN CASE OF SHOT FROM ROUGH |

METHOD OF MANUFACTURING GOLF CLUB HEAD AND GOLF CLUB HEAD

BACKGROUND OF THE INVENTION

1. Field of the Invention

The present invention relates to a golf club head and, more particularly, to score lines on the face.

2. Description of the Related Art

Generally, on the face of a golf club head, a plurality of straight grooves are formed parallel to each other in the toe-and-heel direction (e.g., Japanese Patent Laid-Open Nos. 10-248974 and 2005-169129). These grooves are called score lines, marking lines, face lines, or the like (to be referred to as score lines in this specification). These score lines have an effect of increasing the back spin amount or suppressing a significant decrease in back spin amount of a shot in a case of a rainy day or a shot from rough. As a method of forming score lines, for example, cutting, forging, or casting is used.

The width of a score line is narrow and, for example, that of a score line of a golf club head for competitions is determined to be 0.9 mm or less by the rule. It is not always easy to form a plurality of score lines to be straight and parallel to each other. For example, when forming score lines by cutting, the score lines may be slightly distorted due to the shake or wear of a cutting tool or distortion of the material of the face. In case of forging, score lines may be slightly distorted due to the influence of distortion of the material of the face. In case of casting, score lines may be slightly distorted due to shrinkage. When score lines are distorted, their outer appearance becomes poor. In addition, individual difference in performance between the products may occur.

SUMMARY OF THE INVENTION

It is an object of the present invention to provide a golf club head having score lines with little distortion.

According to the present invention, there is provided a method of manufacturing a golf club head having a plurality of score lines on a face, comprising a first forming step of forming grooves for the score lines on the face, and a second forming step of forming flat surfaces inclined with respect to the face by cutting into the edges of the grooves formed in the first forming step.

In the present invention, the grooves are formed in the first forming step, and the flat surfaces are formed by cutting into the edges of the grooves in the second forming step, thereby forming score lines having the flat surfaces. Since only the edges of the grooves are cut in the second forming step, the cut amount can be small. Accordingly, the shake or wear of a cutting tool or distortion of the material of the face is small, and therefore machining with a higher accuracy is possible. For the outer appearance or performance of the score lines which is influenced by the boundary portions of the score lines and face, since the flat surfaces which form the boundary portions can be machined with a higher accuracy in the second forming step, the machining accuracy of the score lines substantially increases. Therefore, a golf club head having score lines with little distortion can be provided.

According to the present invention, there is provided a golf club head having a plurality of score lines on a face, wherein the score lines are formed by first forming grooves for the score lines and forming flat surfaces inclined with respect to the face by cutting into the edges of the grooves.

According to the present invention, there is provided a golf club head having a plurality of score lines on a face, wherein the score lines include flat surfaces formed at both edges of the score lines and inclined with respect to the face.

Other features of the present invention will become apparent from the following description of an exemplary embodiment with reference to the attached drawings.

BRIEF DESCRIPTION OF THE DRAWINGS

FIG. 5A shows tables of the measurement data of the score lines of an example of the present invention;

FIG. 5B shows tables of the measurement data of the score lines of a comparative example; and FIG. 6 is a table showing the actual measurement values of the groove widths (groove widths W1 in FIG. 2) of the score lines and the evaluations of the machinabilities and test shot results obtained when the edge angle (angle θ2 in FIG. 3B) of the first formed groove and the inclination angle (angle θ1 in FIG. 2) of the flat surface with respect to the face changed.

DESCRIPTION OF THE EMBODIMENTS

Figure 1:
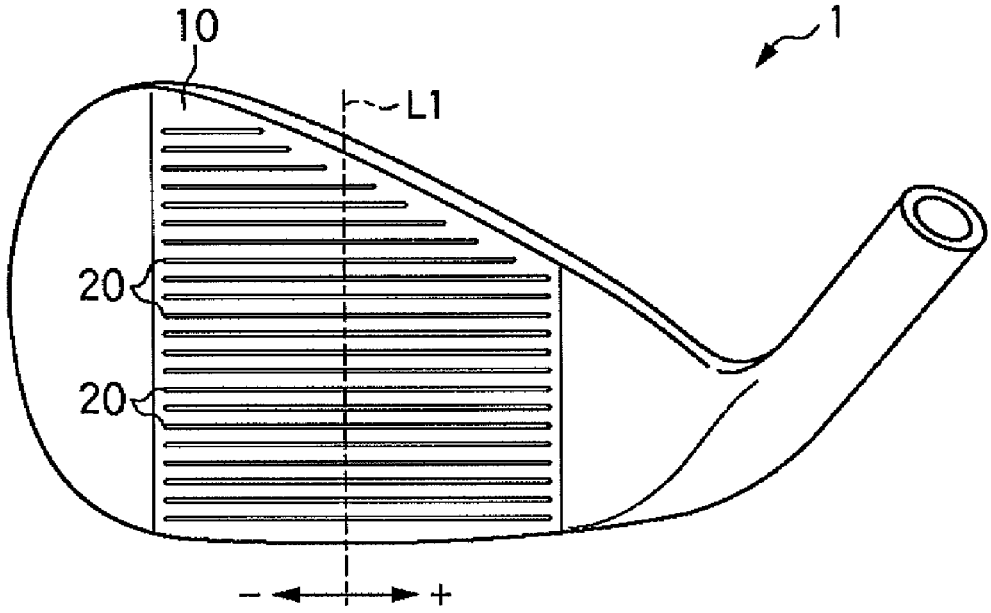
FIG. 1 is a view showing the outer appearance of a golf club head 1 according to an embodiment of the present invention.

FIG. 1 is a view showing the outer appearance of a golf club head 1 according to an embodiment of the present invention. FIG. 1 shows an example in which the present invention is applied to an iron golf club head. The present invention is suitable for short iron golf club heads and wedge iron golf club heads, e.g., golf club heads with a loft angle of 40° to 70° (both inclusive) and a head weight of 260 g to 320 g (both inclusive). However, the present invention is also applicable to wood or hybrid golf club heads.

Figure 2:
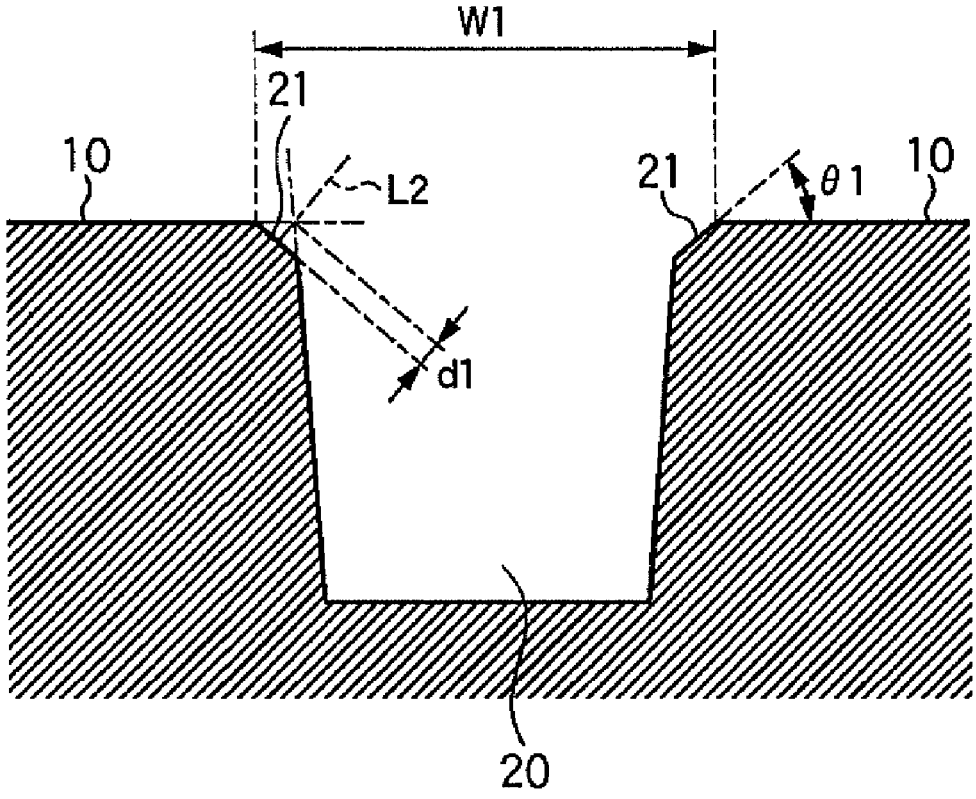
FIG. 2 is a sectional view showing a score line 20 in a direction perpendicular to the longitudinal direction (toe-and-heel direction)

The golf club head 1 has a plurality of score lines 20 formed on its face 10. The respective score lines 20 are straight grooves extending in the toe-and-heel direction and parallel to each other. In this embodiment, the respective score lines 20 are arranged at regular intervals (same pitch) but they may be arranged at irregular intervals. FIG. 2 is a sectional view showing the score line 20 in a direction perpendicular to the longitudinal direction (toe-and-heel direction). In this embodiment, the sectional shapes of the score lines 20 are the same except in two end portions in the longitudinal direction. The score lines 20 have the same sectional shape.

In this embodiment, the sectional shape of the score line 20 is an almost trapezoid. However, the sectional shape of the score line 20 is not limited to this, and may be an almost square or triangle. In this embodiment, the sectional shape of the score line 20 is symmetric. Flat surfaces 21 inclining with respect to the face 10 by an angle θ1 are formed in the edges (boundary portions with the face 10) of the score line 20 uniformly along its longitudinal direction.

The method of forming the score lines 20 will be described next. In this embodiment, upon forming the score lines 20, grooves for the score lines 20 are first formed on the face 10 (first forming step). These grooves will be referred to as first formed grooves, hereinafter. The edges of the first formed grooves are cut so as to form the flat surfaces 21 (second forming step), thereby finishing the score lines 20.

Upon cutting for forming the flat surfaces 21, an NC (numerically controlled) milling machine can be used to perform cutting with a higher accuracy. The first formed grooves may be formed by, e.g., any of cutting, forging, and casting. Since the flat surfaces 21 are formed after the first formed grooves, cutting is desirable. Particularly when the flat surfaces 21 are formed using an NC milling machine, it is desirable to cut the first formed grooves by using the same NC milling machine. A case in which the same NC milling machine is continuously used to form the first formed grooves and the flat surfaces 21 will be described below.

Figure 3A:
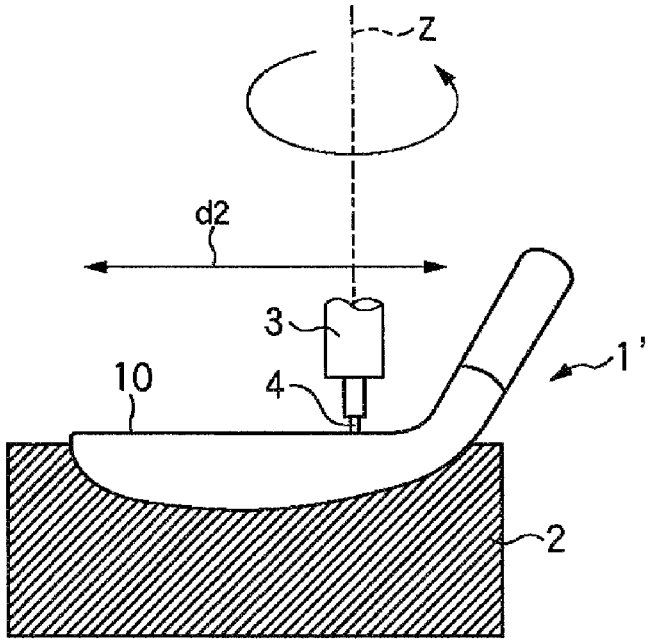
FIG. 3A is a schematic view illustrating an example of a case in which a first formed groove is cut by an NC milling machine.

FIG. 3A is a schematic view illustrating an example of a case in which a first formed groove is cut using an NC milling machine. A golf club head 1' without the score lines 20 is fixed to the NC milling machine via a jig 2. Note that in this embodiment, a case in which the face 10 is integrally formed with the golf club head is described. However, a face member which forms the face 10 and the head body may be prepared as separated members and joined together. In this case, the face member is fixed to the NC milling machine to form the score lines 20.

Figure 3B:
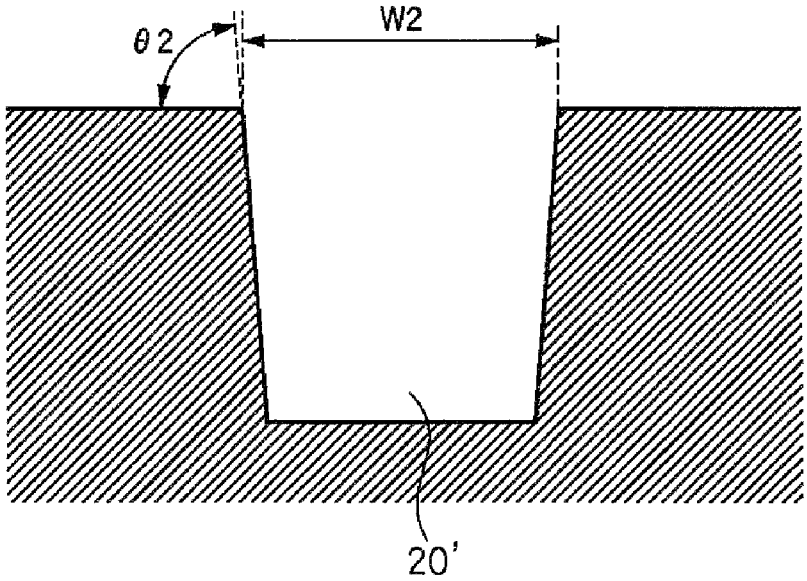
FIG. 3B is a view showing an example of the sectional shape of a first formed groove 20' formed in the first forming step.

The NC milling machine includes a spindle 3 which is rotatably driven around the axis Z. A cutting tool (end mill) 4 is attached to the lower end of the spindle 3. After setting the plane coordinates of the face 10 in the NC milling machine, the spindle 3 is rotatably driven. The face 10 (golf club head 1') or cutting tool 4 is moved relatively in a formation direction d2 of the score lines 20 to mill the face 10, thereby forming a first formed groove. When one first formed groove has been formed, the cutting tool 4 is separated from the face 10. After that, the cutting tool 4 is moved relatively in a direction perpendicular to the formation direction d2 of the score lines 20, and the next first formed groove is formed. In this manner, the first formed grooves are sequentially formed. The positions of the respective first formed grooves are numerically controlled in accordance with design data. FIG. 3B is a view showing an example of the sectional shape of a first formed groove 20' formed in the first forming step.

Figure 4A:
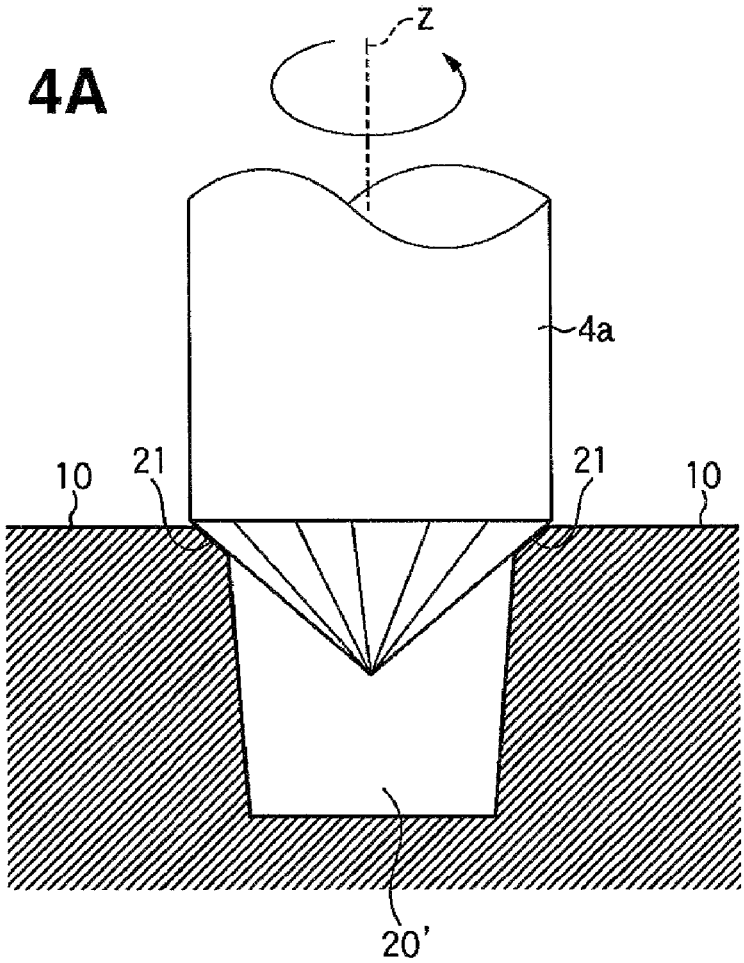
FIG. 4A is a view illustrating a machining example of a case in which a cutting tool 4*a* is used which simultaneously machines flat surfaces 21 at both edges of the first formed groove 20'.
Figure 4B:
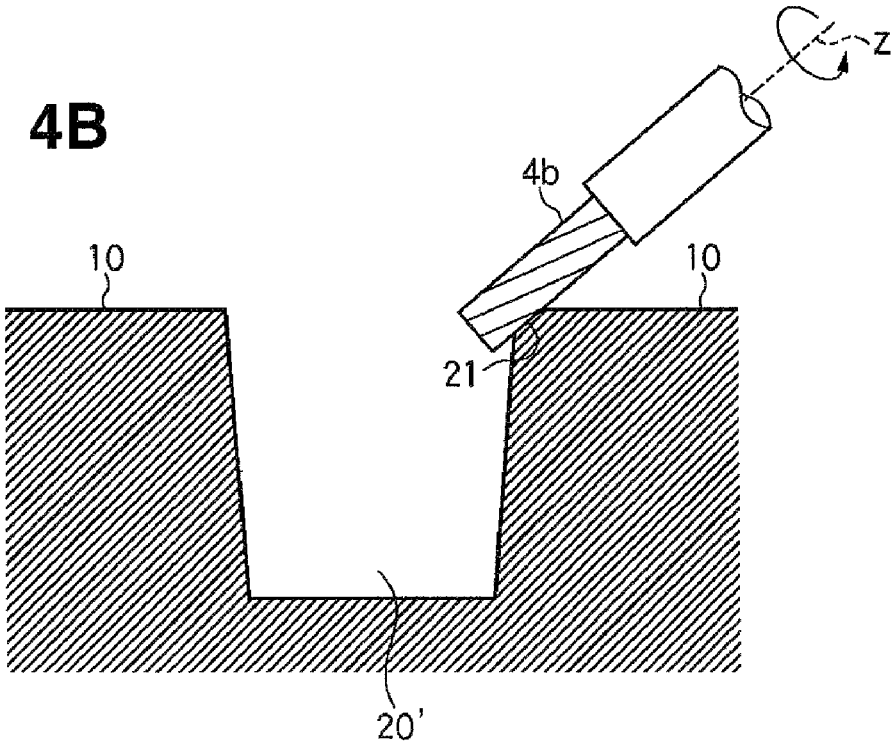
FIG. 4B is a view illustrating a machining example of a case in which the flat surface 21 is machined by relatively inclining the rotation axis Z of a cutting tool 4*b* with respect to the face 10.

When all the first formed grooves have been formed, the flat surfaces 21 are then machined. At this time, the cutting tool 4 is changed as needed. FIG. 4A illustrates a machining example of a case in which a cutting tool 4*a* is used which simultaneously machines the flat surfaces 21 at both edges of the first formed groove 20'. In this case, the inclination angle (angle θ1 in FIG. 2) of the flat face 21 with respect to the face 10 depends on the distal shape of the cutting tool 4*a*. FIG. 4B illustrates a machining example of a case in which the flat surface 21 is machined by relatively inclining the rotation axis Z of a cutting tool 4*b* with respect to the face 10. In this case, it is required to use an NC milling machine which can adjust the relative inclination angle of the rotation axis Z with respect to the face 10. The inclination angle (angle θ1 in FIG. 2) of the flat face 21 with respect to the face 10 depends on the relative inclination angle of the rotation axis Z with respect to the face 10.

Each flat surface 21 is formed by moving the face 10 (golf club head 1') or cutting tool 4*a* or 4*b* relatively in the formation direction d2 (FIG. 3A) of the score lines 20, as in the case of the first formed groove 201, so as to mill the edge of the first formed groove 201. The positions of the respective flat surfaces 21 are numerically controlled in accordance with design data. When the flat surfaces 21 have been completely formed, the score lines 20 having the sectional shape shown in FIG. 2 are completely formed. Note that after that, the surface of the face 10 may be cut as the surface finish of the face 10.

In this embodiment, as described above, the first formed grooves 20' are formed, and then the flat surfaces 21 are formed by cutting into the edges of the first formed grooves 20', thereby forming the score lines 20 having the flat surfaces 21. In forming the flat surfaces 21, since only the edges of the machined first formed groove 20' are cut, the cut amount can be small. Accordingly, the shake or wear of the cutting tool or distortion of the material of the face 10 is small, and therefore machining with a higher accuracy is possible. For the outer appearance or performance of the score lines 20 which is influenced by the boundary portions of the score lines 20 and face 10, since the flat surfaces 21 which form the boundary portions can be machined with a higher accuracy, the machining accuracy of the score lines 20 substantially increases. Therefore, the golf club head 1 having the score lines 20 with little distortion can be provided. As a secondary effect, since the edge angle of the score lines 20 becomes smaller than that of the first formed grooves 20' owing to the presence of the flat surfaces 21, damage to a golf ball can decrease.

Note that when cutting the flat surfaces 21, the small cut amount is desirable in order to improve the machining accuracy and reduce the wear of a cutting tool. Accordingly, the cut depth in a direction perpendicular to the flat surface 21 by a cutting tool is desirably, e.g., 0.1 mm or less. More specifically, in FIG. 2, the maximum cut depth (the distance from the apex of the first formed groove to the flat surface 21 in the example shown in FIG. 2) in a direction L2 perpendicular to the flat surface 21 is desirably 0.1 mm or less.

EXAMPLES

FIG. 5A shows the measurement data of the score lines of an example of the present invention, and FIG. 5B shows the measurement data of the score lines of a comparative example. For the score lines of the example, first formed grooves and flat surfaces were formed using an NC milling machine. The groove depth of the first formed groove was set to 0.45 mm (design value); the edge angle (angle θ2 in FIG. 3B), 60° (design value); and the groove width (W2 in FIG. 3B), 0.8 mm. The flat surface angle (angle θ1 in FIG. 2) was set to 40.4° (design value). The score lines of the comparative example were formed by casting such that they had no portion corresponding to the flat surface of the example (the same shape as the first formed groove of the example). The groove depth of the score line of the comparative example was set to 0.45 nm (design value); the edge angle, 60° (design value); and the groove width, 0.7 mm (design value).

In FIGS. 5A and 5B, "groove width and measurement position (mm)" indicates the actual measurement values of the groove widths at a plurality of positions on the score line, which is the groove width W1 in FIG. 2 for the example. In this embodiment, four score lines were set as measurement targets. Each of 0 and ±1 to ±4 indicates the measurement position. A phantom line (line L1 in FIG. 1), which passes the point of contact of the golf club head with the ground upon soling the golf club head and is perpendicular to the score lines, is set as a reference (measurement position=0). The positions away from the line L1 toward the toe side are denoted by sign −, and those away from the line L1 toward the heel side are denoted by sign +. For example, "+1" indicates a position which is shifted from the line L1 by 1 mm toward the heel side, and "−2" indicates a position shifted from the line L1 by 2 mm toward the toe side.

A standard deviation (same groove) indicates the standard deviation of the groove widths at the respective positions on the same score line, and a standard deviation average value (same groove) indicates the average value of the standard deviations (same groove) of four score lines. An error range (same groove) indicates the difference between the maximum value and minimum value of the groove widths at the respective positions on the same score line, and an error range average value (same groove) indicates the average value of the error ranges (same groove) of four score lines.

A standard deviation (between grooves) indicates the standard deviation of the groove widths at the same position on the respective score lines, and a standard deviation average value (between grooves) indicates the average value of the standard deviations (same groove) of all the measurement positions. An error range (between grooves) indicates the difference between the maximum value and minimum value of the groove widths at the same position on the respective score lines, and an error range average value (between grooves) indicates the average value of the error ranges (between grooves) of all the measurement positions.

Referring to the measurement data shown in FIGS. 5A and 5B, the accuracy of groove width of the score lines of the example is much higher than that of groove width of the score lines of the comparative example. Particularly, there is a significant difference between the data between grooves.

FIG. 6 is a table showing the measurements of the actual measurement values of the groove widths (groove widths W1 in FIG. 2) of the score lines and the evaluations of the machinabilities and test shot results obtained when the edge angle (angle θ2 in FIG. 3B) of the first formed groove and the inclination angle (angle θ1 in FIG. 2) of the flat surface with respect to the face changed. Twelve golf club heads (Nos. 1 to 12) were measured and evaluated. For golf club head Nos. 1, 2, and 12, only first formed grooves were machined without flat surfaces.

In FIG. 6, "in first formation" indicates the groove width (W2 in FIG. 3B) of the first formed groove, the design value of the edge angle (angle θ2 in FIG. 3B), and the evaluation of the machinability. "After flat surface formation" indicates the actual measurement value of the groove width (W1 in FIG. 2), the flat surface angle (angle θ1 in FIG. 2) of the score line having the flat surface, and the evaluation of the machinability. "Test shot result" indicates the test shot result obtained by using each golf club head.

As in golf club head Nos. 3 to 11, when the edge angle θ2 of the first formed groove and the flat surface angle θ1 with respect to the face change, score lines having a plurality of types of groove widths can be obtained. When the flat surfaces are formed in the edges of the score lines, not only the machining accuracy of the score lines can improve but also the degree of freedom of groove width design can increase.

As for the machinability of the first formed groove, since golf cub head Nos. 1 and 2 have the large angle θ2, its machinability was not very good because of the draft. Golf club head Nos. 3 to 12 had no particular problem. Accordingly, from the viewpoint of the machinability of the first formed groove, the angle θ2 is desirably smaller than 85°. Upon machining the flat surface, when the edge angle θ2 of the first formed groove is small, the shake of the cutting tool and cutting resistance are small. This is desirable, however, if the edge angle θ2 is too small, the sectional area of the groove becomes small. This undesirably causes a low spin tendency (tendency for back spin to decrease) in case of a shot from rough or the like. Therefore, the edge angle θ2 of the first formed groove is desirably 60° to 80°.

As for the machinability of the flat surface, golf club head No. 5 had the excessively small fiat surface angle θ1 so that it was difficult to attain a satisfactory accuracy. Therefore, from the viewpoint of the machinability, the flat surface angle θ1 is desirably 20° or more.

As for the test shot result, the large flat surface angle θ1 is desirable from the viewpoint of an increase in spin amount of a ball, however, the ball is easily damaged. Golf club head No. 9 easily damaged the ball. Accordingly, from the viewpoint of an decrease in damage to the ball, the flat surface angle θ1 is preferably smaller than 55° and, more preferably, is equal to or smaller than 50°.

Accordingly, from both the viewpoints of the machinability and a decrease in damage to a ball, the flat surface angle θ1 is desirably 20° to 50° (both inclusive). Note that a significant decrease in spin amount sometimes occurred in case of a shot from rough when using golf club head No. 12, but that did not occur in the same situation when using golf club head Nos. 1 to 11. This is presumably because golf club head No. 12 has the small angle θ2 and the small groove volume with which the head readily caught the grass.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-192623, filed Jul. 24, 2007, which is hereby incorporated by reference herein in its entirety.

What is claimed is:

1. A method of manufacturing a golf club head having a plurality of score lines on a face, comprising:

a first forming step of forming grooves for the score lines on the face; and a second forming step of forming flat surfaces inclined against a plane of the face at both edges of the grooves by cutting into the edges, wherein a side surface of the groove is inclined against the plane by an angle that is equal to or more than 60 degrees and not greater than 80 degrees.

2. The method according to claim 1, wherein the flat surfaces are formed by an NC milling machine.

3. A method of manufacturing a golf club head having a plurality of score lines on a face, comprising:

a first forming step of forming grooves for the score lines on the face; and a second forming step of forming flat surfaces inclined against a plane of the face at both edges of the grooves by cutting into the edges, wherein the flat surfaces are formed by an NC milling machine, and wherein in the second forming step, the flat surfaces are formed by cutting the edges of the grooves by a cutting tool while the face or the cutting tool relatively moves in a direction of forming the score lines.

4. The method according to claim 3, wherein a cutting depth in a direction perpendicular to the flat surface by the cutting tool in the second forming step is not greater than 0.1 mm.

5. A method of manufacturing a golf club head having a plurality of score lines on a face, comprising:

a first forming step of forming grooves for the score lines on the face; and a second forming step of forming flat surfaces inclined against a plane of the face at both edges of the grooves by cutting into the edges, wherein the flat surface is inclined against the plane by an angle that is smaller than 55 degrees, and wherein the flat surfaces are formed by an NC milling machine.

6. A method of manufacturing a golf club head having a plurality of score lines on a face, comprising:

a first forming step of forming grooves for the score lines on the face; and a second forming step of forming flat surfaces inclined against a plane of the face at both edges of the grooves by cutting into the edges, wherein the flat surface is inclined against the plane by an angle that is equal to or more than 20 degrees and not greater than 50 degrees, and wherein the flat surfaces are formed by an NC milling machine.

7. A method of manufacturing a golf club head having a plurality of score lines on a face, comprising:

a first forming step of forming grooves for the score lines on the face; and a second forming step of forming flat surfaces inclined against a plane of the face at both edges of the grooves by cutting into the edges, wherein a side surface of the groove is inclined against the plane by an angle that is smaller than 85 degrees, and wherein the flat surfaces are formed by an NC milling machine.

8. A golf club head having a plurality of score lines on a face, wherein the score lines are formed by first forming grooves for the score lines on the face and forming flat surfaces inclined against a plane of the face at both edges of the grooves by cutting into the edges, wherein a side surface of the groove is inclined against the plane by an angle that is equal to or more than 60 degrees and not greater than 80 degrees.

* * * * *